US008992386B2

(12) United States Patent
Zanetta et al.

(10) Patent No.: US 8,992,386 B2
(45) Date of Patent: Mar. 31, 2015

(54) STARTING DEVICE FOR A COMPETITOR IN A SPORTS COMPETITION

(75) Inventors: André Zanetta, Wavre (CH); Cédric Grimm, Bienne (CH); Reto Galli, Bern (CH)

(73) Assignee: Swiss Timing, Corgemont (CH)

( * ) Notice: Subject to any disclaimer, the term of this patent is extended or adjusted under 35 U.S.C. 154(b) by 168 days.

(21) Appl. No.: 13/482,082

(22) Filed: May 29, 2012

(65) Prior Publication Data

US 2012/0316036 A1 Dec. 13, 2012

(30) Foreign Application Priority Data

Jun. 7, 2011 (EP) ..... 11168981

(51) Int. Cl.
*A63B 71/00* (2006.01)
*A63K 3/00* (2006.01)
*A63K 3/02* (2006.01)

(52) U.S. Cl.
CPC .. *A63K 3/02* (2013.01); *A63K 3/023* (2013.01)
USPC ..... 482/8; 482/19; 482/14

(58) Field of Classification Search
USPC ..... 482/1, 8, 14, 19, 55; 73/379.01–379.05; 473/218, 270–273, 452; 434/255
See application file for complete search history.

(56) References Cited

U.S. PATENT DOCUMENTS 2,165,749 A * 7/1939 Engholm et al. ..... 340/323 R
2,978,692 A * 4/1961 Riley ..... 340/323 R
3,400,928 A * 9/1968 Weidacher ..... 482/8
3,401,931 A * 9/1968 McCafferty et al. ..... 482/19
3,724,843 A * 4/1973 Fichter et al. ..... 482/8
3,731,298 A * 5/1973 Weidacher ..... 340/573.1
3,746,335 A * 7/1973 Fichter et al. ..... 482/19
4,611,803 A * 9/1986 Newton, Jr. ..... 482/19
5,467,652 A * 11/1995 Richards ..... 73/379.01
6,002,336 A * 12/1999 Widding et al. ..... 340/573.1
7,973,274 B2 * 7/2011 Kuniyoshi et al. ..... 250/231.19

FOREIGN PATENT DOCUMENTS

WO 99/32889 A2 7/1999

OTHER PUBLICATIONS

European Search Report for EP 11 16 8981 dated Oct. 27, 2011.

* cited by examiner

*Primary Examiner* — Loan H Thanh
*Assistant Examiner* — Garrett Atkinson
(74) *Attorney, Agent, or Firm* — Sughrue Mion, PLLC

(57) ABSTRACT

The competitor starting device in a sports competition is a starting block device. It includes one rear base for holding the device on a competition surface, a force detection sensor connected to a processing circuit, and two starting blocks for competitor's feet. Each block is adjustably mounted on a longitudinal bar, which is connected to the base and activates the sensor to determine a response time at the competition start. The longitudinal bar is connected to an H-shaped structure having two strips, spaced apart. The strip ends are rigidly connected to an immobile portion of the rear base, while a central bar connecting the strips is secured to the rear end of the longitudinal bar. When a force is applied to the block(s), the central bar is pushed in one direction via the bending of the strips to activate the sensor to determine a response time at the competition start.

19 Claims, 4 Drawing Sheets

STARTING DEVICE FOR A COMPETITOR IN A SPORTS COMPETITION

This application claims priority from European Patent Application No. 11168981.6 filed Jun. 7, 2011, the entire disclosure of which is incorporated herein by reference.

FIELD OF THE INVENTION

The invention concerns a starting device for a competitor in a sports competition. The device includes at least one base for fixedly holding the device on a competition surface, a detection sensor connected to an electronic processing circuit, and a block for at least one foot. This block is connected to the base and activates the detection sensor to determine the competitor's response time at the start of the competition.

The invention also concerns a method for activating the starting device to measure the competitor's response time at the start of the sports competition.

BACKGROUND OF THE INVENTION

It is to be noted that a "starting device" means both a starting block device for athletics and a starting platform or block for swimming or another sport. This starting device must allow the competitor's response time to be determined, particularly following the start signal of the competition, and must also indicate any false start.

Currently, a starting device, such as a starting block device, may include, on the base structure, a detection means for determining a competitor's response time at the start of an athletics race. This detection means is generally formed of a sensor placed, for example, on a block for a runner's foot. The sensor may be a simple electric switch which is closed when sufficient force is applied to the block when the competitor pushes off at the start, and which is greater than a determined threshold. This involves an inconvenient backward movement of the block, which, moreover, is not unidirectional. Further, the sensor has to be adjusted according to the type of race and the competitors who are competing. A competitor may also apply a sufficient constant force to the block to close the sensor switch as he gets into position prior to the start. This prevents the response time from being precisely measured when the start signal for the race is given. This constitutes several drawbacks for this type of starting block.

U.S. Pat. No. 5,467,652 discloses a starting block device for an athletics race. This starting block device includes a longitudinal bar for anchorage to the ground, on which are placed a first foot block and a second foot block respectively on each side of the bar. The blocks can be moved along the length of the bar, guided in lateral grooves in the bar and adjusted by pins inserted in one of the holes provided in the bar. Each block has a foot bearing surface which is angularly adjustable and covered with a pressure sensitive elastomer pad. These pressure pads are connected to a control and display module by electric cables. The pressure pad sensors are connected to amplifiers, which supply analogue output signals that vary according to the measured pressure. When the start signal of a race is given, the starting block device is capable of measuring, storing and displaying the pressure levels detected on each bearing surface. It can also determine the time that elapses between the start signal and the runner's start on the basis of the variation in pressure measured on the blocks so as to indicate any false start. However, the action of a runner's foot against one of the sensor pads does not occur in a single direction. This may lead to imprecision in the start time measurement, which constitutes a drawback. Moreover, nothing is provided to overcome any malfunction in each sensor.

WO Patent Application No. 99/32889 discloses a system for measuring the response time when a runner starts from a starting block device secured to the ground. The start time measurement is obtained via an accelerometer arranged on at least one starting block of the starting block device. The accelerometer is mounted on the starting block via a rigid coupling. A measured acceleration over time curve at the start of a race can be determined and displayed on a display screen. As in the preceding document, nothing is provided to guarantee a unidirectional movement of the block in order to measure the start time precisely. Moreover, the use of an accelerometer intrinsically means that a precise start time measurement cannot be obtained when the competitor pushes off, which is a drawback.

SUMMARY OF THE INVENTION

It is therefore an object of the invention to overcome the drawbacks of the aforementioned state of the art by proposing a starting device capable of precisely indicating the start of any competitor in a sports competition regardless of the value of the force applied to the device at the start of the race.

The invention therefore concerns a starting device for a competitor in a sports competition, the device including at least one base for fixedly holding the device on a competition surface, a detection sensor connected to an electronic processing circuit, and a block for at least one foot, which is connected to the base and which activates the detection sensor to determine the response time of the competitor at the start of the competition, wherein the block is connected to an H-shaped structure, which includes two spaced apart strips, wherein the ends of said two strips are rigidly connected to an immobile portion of the device, while a central bar connecting the two strips can be pushed in a preferred direction via the bending of the two strips to activate the detection sensor when a force is applied against the block by at least one foot of a competitor.

Specific embodiments of the starting block device are defined in the dependent claims 2 to 17.

One advantage of the starting device lies in the fact that the H-shaped structure central bar activates the detection sensor, such as a force sensor, by a movement in a single direction, which is the desired preferred direction. Owing to the two metallic strips of the H-shaped structure, the ends of which are kept rigidly immobile, the central bar can only be pushed by bending the strips in one direction according to the level of force applied to the block. In these conditions, a precise response time measurement can be made, if the detection sensor is properly calibrated at the start of the sports competition. The detection sensor is therefore connected to an electronic processing circuit so as only to take account of a variation in the force applied to the block of the device following the start signal supplied, for example, by an electronic starting pistol. This no longer depends on the value of the force applied to the block and can be adapted to any type of competitor, whether young or old.

Advantageously, the force sensor is kept in contact with the rear end of the central bar by a threaded element screwed into a thread in a rear unit of the immobile portion of the device. Owing to this threaded element, the H-shaped structure can be prestressed at rest via the force sensor. This enables the measurement of the force applied to the block at the start to be better linearised in order to determine the competitor's response time.

Advantageously, the starting device is a starting block device used for an athletics competition. Two blocks can be provided and adjustably mounted along a longitudinal bar, which is fixed to the rear of the central bar of the H-shaped structure. This H-shaped structure is fixed via the ends of the metallic strips to the immobile portion of the base of the starting block device. Two rigid metallic bars of the H-shaped structure are also provided to secure said H-shaped structure to the immobile portion. These two external rigid bars are integral with the two strips and the central bar, so as to form a single part.

The invention therefore also concerns a method for activating a starting device, for determining a response time of a competitor from the block of the device at the start of the sports competition, the method including the steps consisting in:

transmitting a start signal to the starting block device to indicate the initial instant of the start of the competition, measuring, via the detection sensor connected to the electronic processing circuit, the variation in force applied by the competitor to the block at the start by the detection sensor, to determine a response time to be compared to a determined threshold time limit relative to the instant of the start so as to check whether the response time is above the time threshold or below, indicating a false start.

One particular step of the method is defined in the dependent claim 19.

One advantage of the method for activating the starting device lies in the fact that it enables a precise measurement to be made, particularly following the start signal of the sports competition, simply by detecting a variation in the force applied to the block at the start. Owing to an algorithm stored in the electronic processing circuit, this enables the beginning of the runner's response to be detected, in particular after the start signal of the competition has been given. The response time at the start instant thus no longer depends on a determined force threshold, but only on the variation in the force on the block detected by the force sensor. The force sensor connected to the electronic circuit may also be able to supply information relating to a false start a fraction of time before the signal provided by the electronic pistol.

BRIEF DESCRIPTION OF THE DRAWINGS

The objects, advantages and features of the starting device for a sports competition according to the invention will appear more clearly in the following description of at least one non-limiting embodiment illustrated by the drawings, in which.

DETAILED DESCRIPTION OF THE INVENTION

In the following description, all those parts of the starting device that are well known to those skilled in the art in this technical field will be described only in a simplified manner. It is to be noted that the only starting device described is in the form of a starting block for an athletics competition. However, this starting device may also be a starting platform or block for swimming or another sports competition, where it is necessary to determine the response time of the competitor, particularly to detect any false start.

Figure 1:
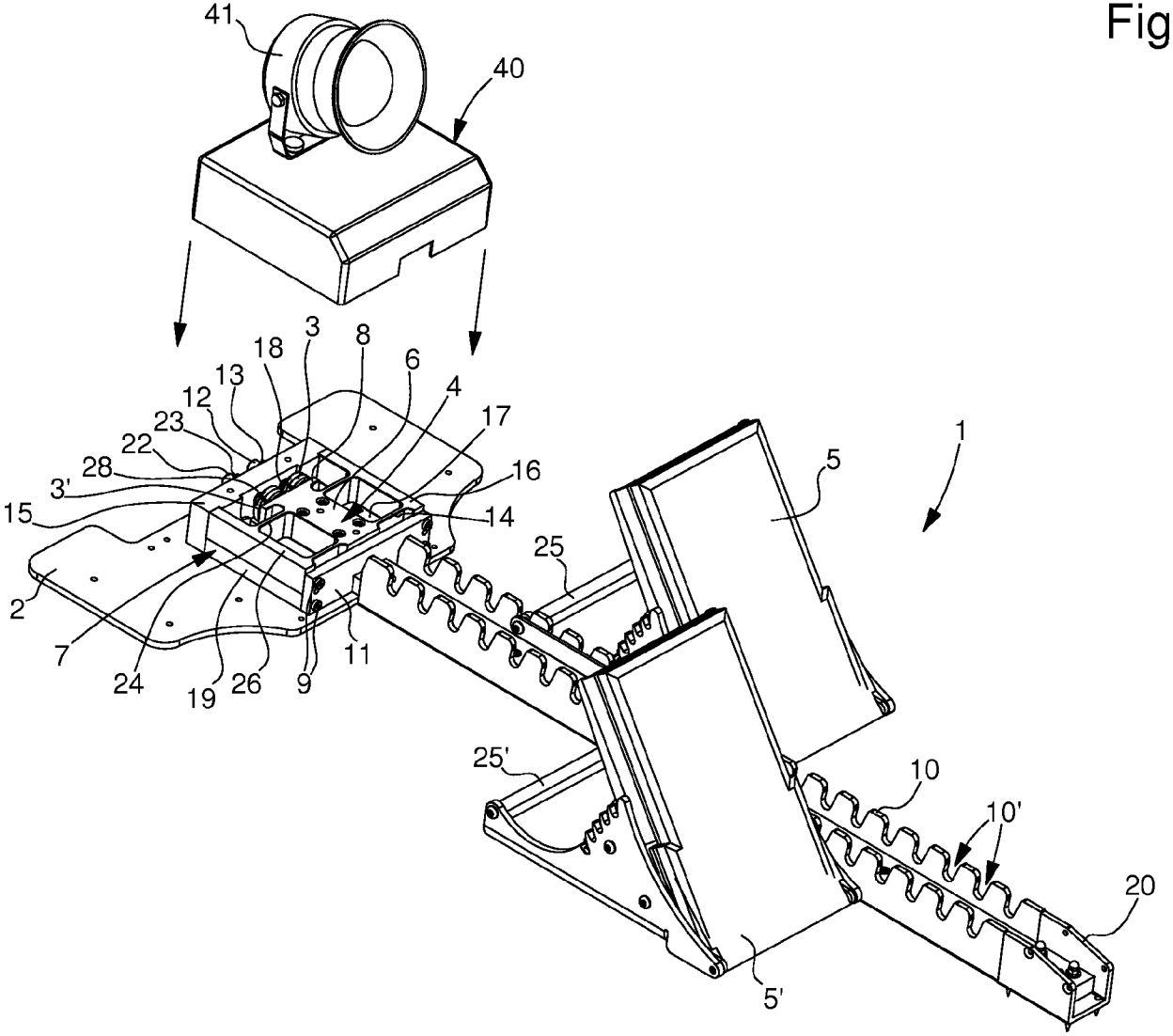
FIG. 1 shows a slightly exploded three-dimensional view of a starting device in the form of a starting block device according to the invention.

FIG. 1 shows a three-dimensional view of all the essential elements of the starting device, which is a starting block device 1. Starting block device 1 mainly includes a base 2, which includes a plate in the back position with fastening elements underneath the plate for fixedly holding the device on a competition surface, such as an athletics track. The plate may be made of metallic material, such as aluminium, for example EN AW-6060. The device further includes at least one detection sensor 3, which is connected to an electronic processing circuit (not shown). This electronic circuit may be formed of a printed circuit board with several electronic components, and arranged underneath a cover 40 to be mounted on the base. Connectors may also be provided at the back of the cover (not shown) for connecting the electronic circuit to a base station to display information provided by said electronic circuit. A warning buzzer 41 or light indicator may also be mounted on the cover to indicate a false start. The detection sensor 3, which is preferably a force sensor, is fixedly held on an immobile portion 7 of the device. The device also includes at least one block 5 for at least one of the runner's feet, which is connected to the base 2 via a longitudinal bar 10.

At the start of a race, the block is pushed towards base 2, which activates the detection sensor to determine the competitor's response time at the start of the competition. In order to do this, the block is connected to an H-shaped structure 4 by longitudinal bar 10. This H-shaped structure includes two strips 14, 24, which are spaced out and flexible in a determined direction. The ends of the two strips are rigidly connected to the immobile portion 7 of the device, while a central bar 6 connects the two strips in an intermediate position. This central bar 6 is preferably connected to longitudinal bar 10 so as to be pushed by the action of the competitor's foot against the block in a preferred direction via the bending of the two strips to activate the sensor.

Preferably, the starting block device includes two blocks 5, 5' each for receiving one of the two feet of a competitor in the sports competition. These blocks may be removably adjusted along the longitudinal bar in different positions and on two opposite sides. The bearing surface of each block, which may be made of a composite material, may also be inclined at a determined angle. Each block 5, 5' includes one or two rods 25, 25' connected to an inner strip to be placed respectively in notches 10' in one of the plates on each side of longitudinal bar 10. This longitudinal bar 10 is secured at a rear end, to central bar 6 of H-shaped structure 4, for example by means of screws, and at a front end to an end portion 20, which is fixedly held on the competition surface like rear base 2. Longitudinal bar 10 is mounted at the end portion yet is free to move in a longitudinal direction. To achieve this, one or two pins may be provided in the front end of the longitudinal bar, sliding into two inner grooves in the end portion.

The immobile portion 7, to which the ends of separate strips 14, 24 of H-shaped structure 4 are secured, is formed of two metallic support bars 17, 19. These two metallic support bars are fixed in parallel onto base plate 2, for example by means of screws (not shown). The immobile portion further includes a front unit 11 and a rear unit 15, which are also made of metallic material. The front and rear units are removably fixed to the two ends of the two metallic support bars to form a frame. The front and rear units are secured, for example by means of screws 9 passing through cylindrical apertures in the units, and screwed into threads made in the support bars. However, the front and rear units may also be welded, soldered or bonded to the ends of the metallic support bars. An aperture is provided in front unit 11, allowing the longitudinal bar 10, secured to central bar 6 of H-shaped structure 4, to pass through. The metal used for immobile portion 7, and base 2, H-shaped structure 4, blocks 5, 5' and longitudinal bar 10 may be a light metal, such as aluminium, for example EN AW-6060. However, other types of metals may also be suitable for making starting block device 1.

H-shaped structure 4 further includes a first external rigid bar 16, secured to the first two ends of the two strips 14, 24 and a second external rigid bar 26, secured to the second two ends of the two strips. Since the H-shaped structure 4 may be made of metallic material, for example aluminium, the two external rigid bars may be integral with strips 14, 24 and central bar 6 so as to form a single piece. The H-shaped structure is therefore fixed to the immobile portion via the two external rigid bars. These two external rigid bars 16 and 26 are arranged in parallel on metallic support bars 17, 19 so as to be secured to front and rear units 11 and 15 of immobile portion 7 by means of screws 9. Of course, the external rigid bars may also be secured to the immobile portion by welding, soldering or bonding.

It is to be noted that the H-shaped structure, made for example of aluminium, is sized to enable strips 14, 24 to bend in the longitudinal direction of movement of longitudinal bar 10. The travel of central bar 6 of the H-shaped structure when a competitor applies force against the blocks may be up to 50 μm against the force sensor or sensors 3, 3'. By way of non-limiting example, the length of external rigid bars 16, 26 may be on the order of 106 mm, and the width on the order of 12 mm. The length of central bar 6 may be on the order of 85 mm with the front end at the same level or slightly staggered with respect to the front ends of the external rigid bars to rest against the front unit of immobile portion 7. The intermediate width of central bar 6 may be on the order of 39 mm, and a base plane or plate 8 for one or two sensors 3, 3' is made at the rear end, with a width extending up to 65 mm and a thickness on the order of 6 mm in the longitudinal direction. The height or thickness in the vertical direction of all the parts of the H-shaped structure may be on the order of 25 mm. The flexible strips 14, 24 are at a distance of around 54 mm from each other and each has a thickness on the order of 4 mm to ensure that they can bend. The length of the flexible strips may be on the order of 120 mm with central bar 6 fixed in the intermediate part of each strip.

The rear unit 15 includes one or two threaded elements 12, 22, which may each be screwed into a respective through thread 18, 28 through the rear unit 15, so as to come into contact with a rear portion of one or two force sensors 3, 3'. Each through thread may have a diameter on the order of 10 mm, and a length on the order of 15 to 20 mm, for example. The front portion of each sensor 3, 3' abuts on the base plane or plate of the rear end 8 of central bar 6. The force sensor or sensors 3, 3' may be pushed against the base plane or plate 8, via the threaded elements, in order to prestress H-shaped structure 4. This allows the response of the sensor(s) connected to the electronic processing circuit to be better linearised.

Each threaded element 12, 22 includes a threaded portion of sufficient length to overshoot the two sides of the rear unit, allowing said element to be easily screwed into the corresponding thread 18, 28 in rear unit 15. A shank of each threaded element is arranged in the extension of the threaded portion, so as to come into contact with the sensor(s) 3, 3'. A ring made of copper-molybdenum 30, 30' may also be provided around the shank, to abut against one of the respective sensors, in order to ensure damping when the H-shaped structure 4 is pre-stressed. Once the prestressing has been adjusted by means of threaded element(s) 12, 22, one nut 13, 23 per threaded element can be screwed onto the threaded portion, so as to come into contact with the external side of rear unit 15 and lock each threaded element.

Figure 2A:
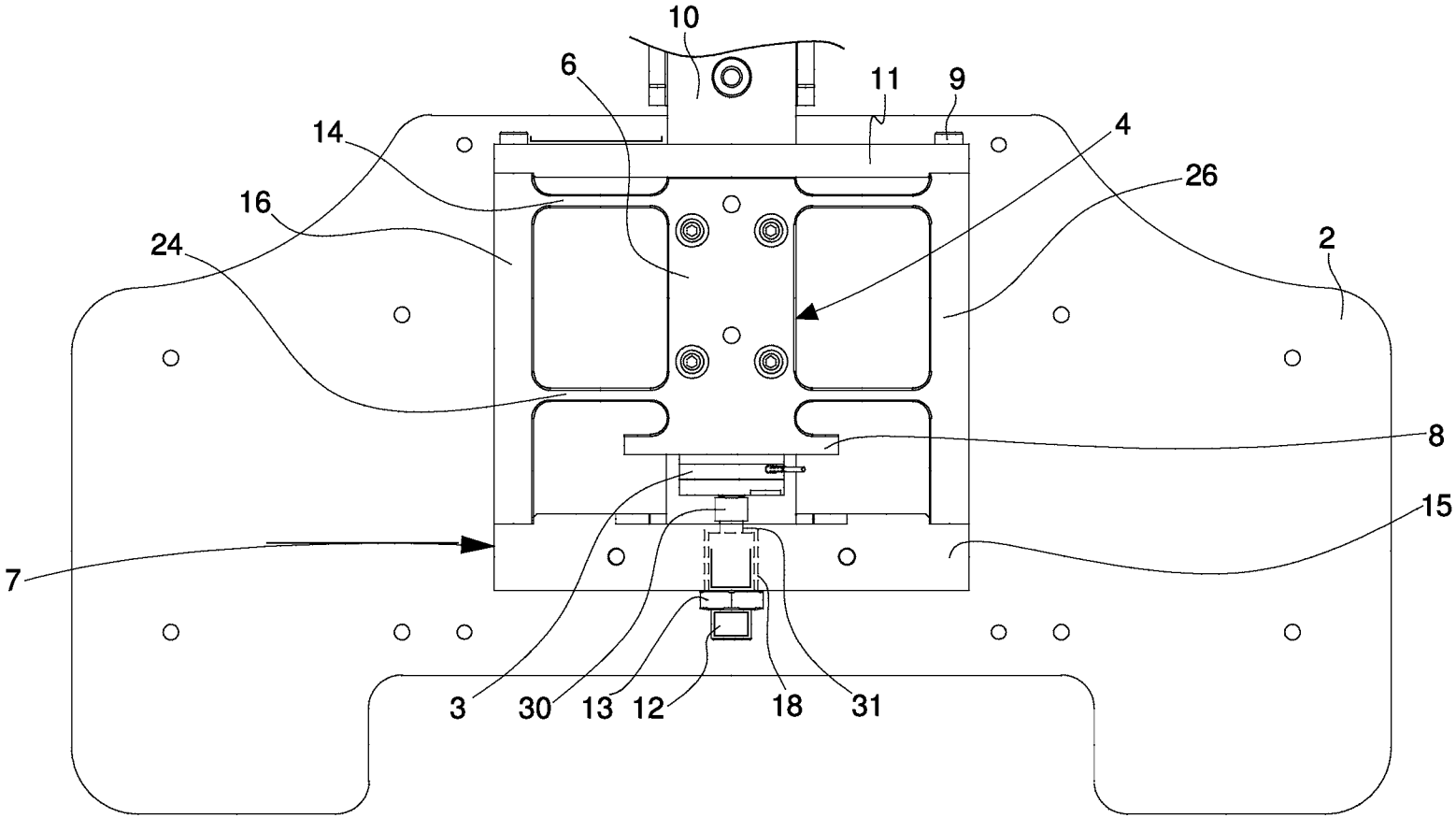
FIG. 2*a* shows a partial top view of a first embodiment showing the base of the starting block device with a detection sensor according to the invention.
Figure 2B:
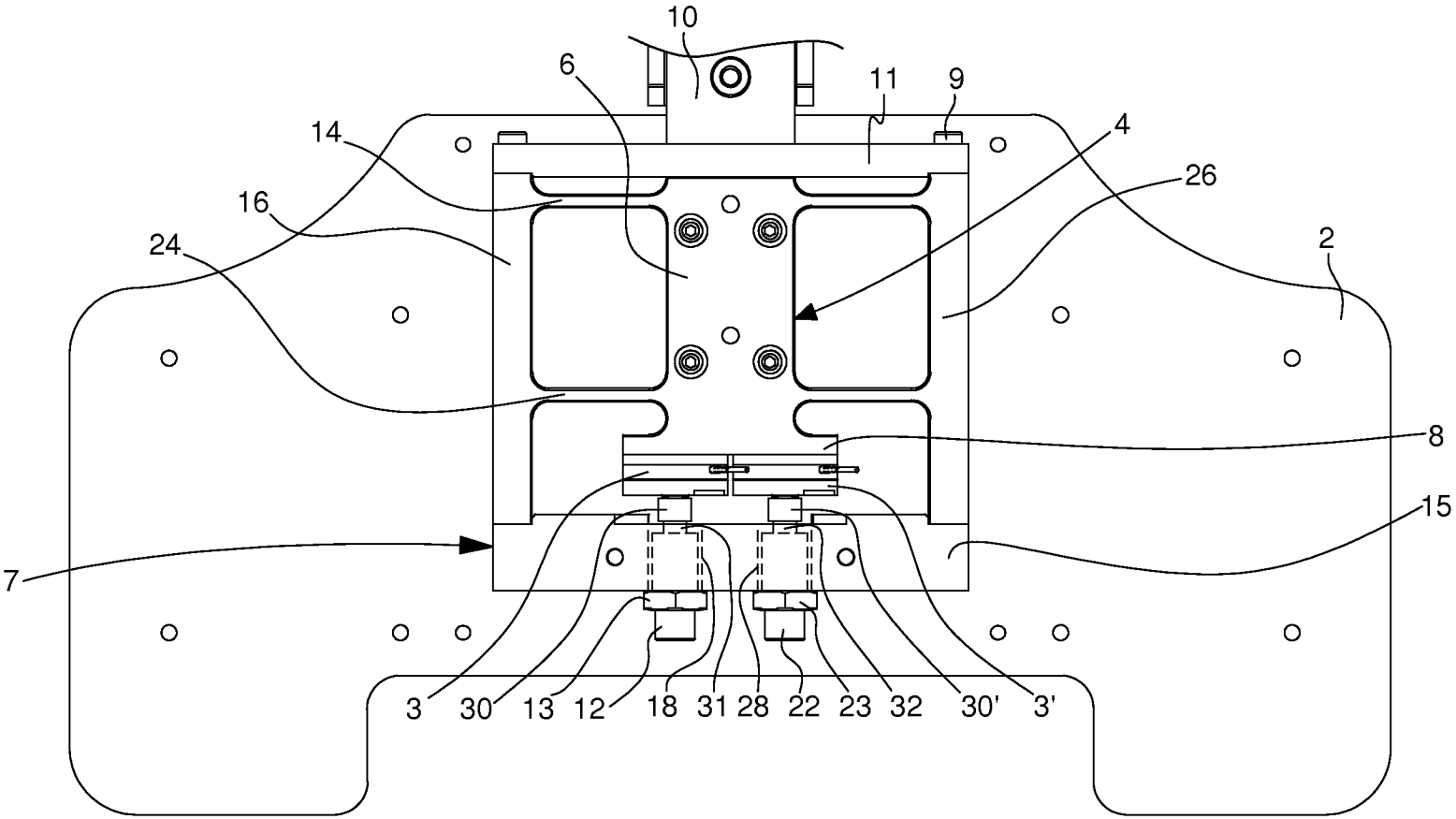
FIG. 2*b* shows a partial top view of a second embodiment showing the base of the starting block device with two parallel detection sensors according to the invention.
Figure 2C:
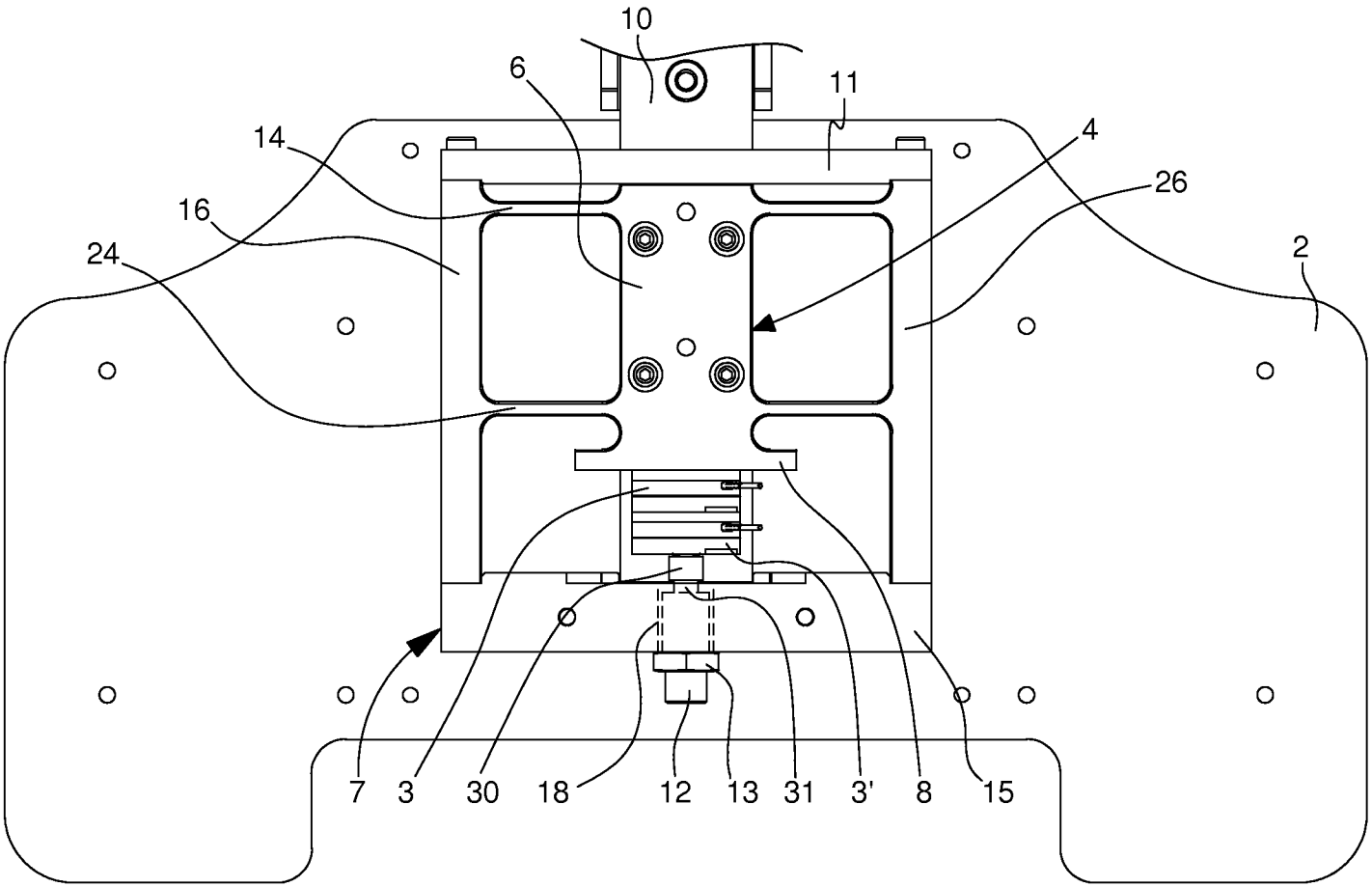
FIG. 2*c* shows a partial top view of a third embodiment showing the base of the starting block device with two detection sensors in series according to the invention.

Various embodiments are presented in FIGS. 2*a* to 2*c* showing rear base 2 of starting block device 1, where H-shaped structure 4 is located. These various embodiments specifically concern the use of one or two detection sensors 3, 3' for determining the response time at the start of the competition, in conjunction with the electronic circuit, which is not shown. The use of two sensors may be advantageous for measuring a competitor's response time at the start, ensuring against any defect in one sensor or the other. Since all the other parts of the starting block device have already been described with reference to FIG. 1, for the sake of simplification, the description of each of these parts will not be repeated. In FIGS. 2*a* to 2*c*, the same references are used to represent parts that are identical to those described with reference to FIG. 1.

FIG. 2*a* shows a first embodiment of the rear base 2 of starting block device 1. A single detection sensor, such as a force sensor 3, is advantageously used. As explained previously, this force sensor 3 is pushed against the base plane 8 of the rear end of central bar 6 of H-shaped structure 4 by shank 31 and ring 30 of threaded element 12. The prestressing of the H-shaped structure can thus be adjusted to ensure a precise linear measurement of the response time with reference to the force applied by the competitor to the blocks at the start of the race.

FIG. 2*b* shows a second embodiment of rear base 2 of starting block device 1. In this case, two parallel force sensors 3, 3' are used. The two force sensors are held abutting against the base plane of rear end 8 of central bar 6 of H-shaped structure 4. Two threaded elements 12, 22 are thus used to push said sensors against said base plane 8, via shanks 31, 32 and rings 30, 30', and to prestress the H-shaped structure to linearise the response time measurement in a similar manner. Although this second embodiment has the advantage, compared to the first embodiment, of ensuring against any defect in one or other sensor, the force measured by each sensor is divided by two. This consequently reduces the measurement precision.

Finally, FIG. 2*c* shows a third embodiment of the rear base 2 of starting block device 1. In this third embodiment, two force sensors 3, 3' are used, mounted in series between base plane 8 of central bar 6 and shank 31 of threaded element 12. This threaded element 12 may be screwed into thread 18 so as to push the two sensors towards the base plane, via shank 31 and ring 30, and prestress the H-shaped structure to linearise the force measurement so as to determine the response time at the start of the race.

In a sports competition in the field of athletics, several starting block devices are generally mounted on the track, each connected by cable or wirelessly to a base station. Each starting block device is provided with at least one detection sensor, which is a force sensor, connected to an electronic processing circuit, in order to determine a response time at the start of the race. Any false start must also be detected a fraction of time (100 ms) before the start signal from the electronic pistol. To achieve this, account must be taken of any force measurement by the sensor within this fraction of time, and also after the start signal. With the starting block device according to the invention, it is possible to reduce the minimum time limit for determining a false start after the race start signal. Normally, in the state of the art, this minimum time limit is set at 100 ms after the start signal. In the current case, this minimum time limit may be reduced on the basis of the real physiological response time of the human body.

The response time at the start of a race is measured precisely with a small movement of the base plate at the rear end of the central bar of the H-shaped structure, so as to determine false starts. A curve of the measured force over time applied to the starting block may also be determined by a processing unit of the electronic circuit and displayed on a display screen on the exterior of the starting block device.

To determine this response time precisely with the starting block device, by a force applied to the block(s), the variation in force is measured by the force sensor connected to the electronic circuit, particularly after the start signal by the electronic pistol. Compared to the state of the art, where detection occurred for a measured force greater than a threshold on the order of 28 kilogram-force, now the sensor only detects the variation in force on the block in order to determine the response time. This force variation measurement is already taken into account a fraction of time (100 ms) before the start signal, and the threshold time limit for detecting any false start following the start signal can be reduced compared to the minimum time limit of the state of the art. This provides several advantages, including independence from the actual value of the force to be applied to the blocks to determine the response time. Practically no difference is observed between a young person and a more powerful adult for determining the response time at the start of a sports competition.

From the description that has just been given, several variants of the starting device for a competitor in a sports competition can be devised by those skilled in the art without departing from the scope of the invention defined by the claims. The starting device may be a swimming platform with the central bar of the H-shaped structure directly connected to the bearing surface for the swimmer and in contact on the other side with the force sensor on the immobile portion of the base. The central bar of the H-shaped structure may be directly connected underneath a bearing surface of the block with the force sensor held on the immobile portion in contact with a rear end of the central bar. Each detection sensor may be an accelerometer or a light sensor or another type of sensor.

What is claimed is:

1. A starting device for a competitor in a sports competition, the device including a base for fixedly holding the device on a competition surface, a detection sensor connected to an electronic processing circuit, and a block for at least one foot, which is connected to the base and which activates the detection sensor to determine the response time of the competitor at the start of the competition, wherein the block is connected to an H-shaped structure, which includes two spaced apart strips each having a first end and a second opposite end, wherein the ends of said two strips are rigidly connected to an immobile portion of the device, while a central bar connecting the two strips can be pushed in a preferred direction via the bending of the two strips to activate the detection sensor when a force is applied against the block by at least one foot of a competitor.

2. The device according to claim 1, wherein the central bar is integral with the two strips of the H-shaped structure, which are made of a metallic material.

3. The device according to claim 2, wherein the ends of the two strips are rigidly connected to the immobile portion of the device via two external rigid bars secured to the ends of the two strips and integral with the two strips and the central bar.

4. The device according to claim 1, wherein the detection sensor, which is held on the immobile portion, is a force sensor, on which a rear end of the central bar of the H-shaped structure abuts.

5. The device according to claim 4, wherein the detection sensor includes two force sensors series mounted with one of the sensors in contact with the rear end of the central bar.

6. The device according to claim 4, wherein the detection sensor includes two force sensors mounted in parallel, with a flat plate shaped portion of the rear end of the central bar abutting on each force sensor.

7. The device according to claim 1, wherein the central bar of the H-shaped structure is connected underneath a bearing surface of the block, and wherein the detection sensor is held on the immobile portion opposite a rear end of the central bar.

8. The device according to claim 1, wherein the starting device is a starting block device, which includes a longitudinal bar having a front end and a rear opposite end, wherein the rear end is connected to the base, which is fixedly held on a competition surface, and the front end is connected to an anchor portion, which is fixedly held on said competition surface, and wherein the starting block device further includes one or two blocks removably and adjustably mounted along the longitudinal bar.

9. The device according to claim 8, wherein the ends of the two strips of the H-shaped structure are rigidly fixed to an immobile portion of the base, and wherein the rear end of the longitudinal bar is secured to the central bar of the H-shaped structure.

10. The device according to claim 9, wherein the immobile portion of the base is formed of two metallic support bars each having a first end and a second opposite end and fixed in parallel to a base plate, a front unit, which is removably secured to the first ends of the two metallic support bars, and a rear unit, which is removably secured to the second ends of the two metallic support bars, and wherein the two metallic support bars, the front unit, and the rear unit form a frame.

11. The device according to claim 10, wherein the ends of the two strips of the H-shaped structure are connected to two external rigid bars which are integral with the metallic strips and the central bar to form a single piece, and wherein the two rigid bars are secured to the front and rear units of the immobile portion and placed on the two support bars of the immobile portion.

12. The device according to claim 11, wherein the front and rear units of the immobile portion are secured to the metallic support bars by means of screws.

13. The device according to claim 10, wherein the detection sensor includes a force sensor or two force sensors mounted in series, and wherein the rear unit includes a thread for receiving a threaded element which is screwed into the thread to come into contact with the force sensor or the two force sensors mounted in series, and to push said sensor or sensors against a rear end of the central bar, so as to prestress the H-shaped structure to linearise the response of the sensor or sensors.

14. The device according to claim 13, wherein the threaded element includes a threaded portion to be screwed into the thread of the rear unit and a shank in an extension of the threaded portion, which comes into contact with the sensor or sensors, and wherein a copper-molybdenum ring is arranged on the shank to abut against one of the sensors, so as to ensure damping during the prestressing of the H-shaped structure.

15. The device according to claim 10, wherein the detection sensor includes two force sensors placed in parallel and in contact with a base plane of a rear end of the central bar, and wherein the rear unit includes two threads each for receiving a threaded element, which is screwed into the corresponding thread to come into contact with the corresponding force sensor and push said sensor against the base plane of the rear end of the central bar, so as to prestress the H-shaped structure to linearise the response of the sensors.

16. The device according to any of claim 15 or 14, wherein a nut is provided for each threaded element, to be screwed onto the corresponding threaded element in order to come into contact with an external side of the rear unit and lock each threaded element after the prestressing of the H-shaped structure has been adjusted.

17. The device according to claim 8, wherein the front end of the longitudinal bar is connected to the anchor portion yet is free to move in a longitudinal direction.

18. A method for activating a starting device including a base for fixedly holding the device on a competition surface, a detection sensor connected to an electronic processing circuit, and a block for at least one foot, which is connected to the base and which activates the detection sensor to determine the response time of the competitor at the start of the competition, wherein the block is connected to an H-shaped structure, which includes two spaced apart strips each having a first end and a second opposite end, wherein the ends of said two strips are rigidly connected to an immobile portion of the device, while a central bar connecting the two strips can be pushed in a preferred direction via the bending of the two strips to activate the detection sensor when a force is applied against the block by at least one foot of a competitor, the method including the steps consisting of:

transmitting a start signal to the starting block device to indicate the initial instant of the start of the competition, and measuring, via the detection sensor connected to the electronic processing circuit, the variation in force applied by the competitor to the block at the start by the detection sensor, to determine a response time to be compared to a determined threshold time limit relative to the instant of the start so as to check whether the response time is above the time threshold or below, indicating a false start.

19. The method according to claim 18, wherein the detection sensor is a force sensor, which is activated a predetermined amount of time before the start signal of the sports competition to determine any false start following measurement of the variation in force applied to the block.

* * * * *